United States Patent [19]

Wedler

[11] 4,432,503

[45] Feb. 21, 1984

[54] MACHINE FOR PRODUCING YARN LOOPS

[75] Inventor: Klaus Wedler, Mittelbiberach, Fed. Rep. of Germany

[73] Assignee: Croon & Lucke Maschinenfabrik GmbH & Co. KG., Mengen, Fed. Rep. of Germany

[21] Appl. No.: 460,484

[22] Filed: Jan. 24, 1983

[30] Foreign Application Priority Data

Jan. 27, 1982 [DE] Fed. Rep. of Germany ..... 3202474

[51] Int. Cl.[3] ..... B65H 51/20

[52] U.S. Cl. ..... 242/47; 28/101; 28/289; 242/53; 242/82

[58] Field of Search ..... 242/47.01, 47, 47.12, 242/47.13, 53, 54 A, 82, 83, 1, 25 R; 28/101, 289; 66/84 A

[56] References Cited

U.S. PATENT DOCUMENTS 3,120,689 2/1964 Drummond ..... 28/289 X
3,332,126 7/1967 Cabello ..... 28/289 X
3,369,280 2/1968 Shattuck et al. ..... 242/47
3,430,312 3/1969 Drummond ..... 28/289

FOREIGN PATENT DOCUMENTS 2097027 10/1982 United Kingdom ..... 242/47.01

*Primary Examiner*—Stanley N. Gilreath
*Attorney, Agent, or Firm*—Barry Kramer

[57] ABSTRACT

A machine for producing yarn loops comprises a rotary winding flyer or member having a discharge end through which the yarn emerges. A winding means for collecting the yarn loops is provided and transfers the loops to a conveyor. In order to secure the end of the yarn as it emerges from the discharge end upon start up of the machine a pair of rings are provided which can be moved relative to each other by a powered device. The rings define complementary surfaces between which the end of the yarn is passed prior to the rings being moved into engagement with each other to secure the end of the yarn. The rings are moved apart after at least one yarn loop has been produced.

14 Claims, 2 Drawing Figures

MACHINE FOR PRODUCING YARN LOOPS

This invention relates to a machine for producing yarn loops and in which yarn loops produced by a rotary winding member are collected by a winding means and transferred to a conveyor belt.

A machine of this type is described in German Published Patent Specification DE-OS No. 31 14 535.3 and at the start of the loop production, it is necessary to grip the end of the yarn for a short time, until at least the first loop has been placed on the winding means. This retention of the end of the yarn has hitherto been effected by hand, which particularly in installations with several such yarn-loop laying machines arranged close to each other, is a time-consuming and complex operation, and not devoid of danger because of the high rotational speed of the winding member.

The object of the invention is to provide a machine of the aforesaid type in which the retention of the end of the yarn for a short time at the beginning of yarn loop production can be achieved in a simple and convenient manner.

According to the invention a machine for producing yarn loops comprises a rotary winding member having a discharge end through which in use, yarn passes, a winding means for collecting the loops of yarn, and conveyor means for conveying the loops received from the winding means to a remote position, characterised by a clamping arrangement for the end of the yarn as it emerges from the discharge end of the winding member during the initial use of the machine, said clamping arrangement comprising a pair of rings surrounding said winding means, said rings defining complementary surfaces the contours of which substantially correspond to the path of movement of the discharge end of the winding member, and means for moving the rings relative to each other so that the end of the yarn emerging from said discharge end can be trapped between said surfaces.

In the accompanying drawings

Figure 1:
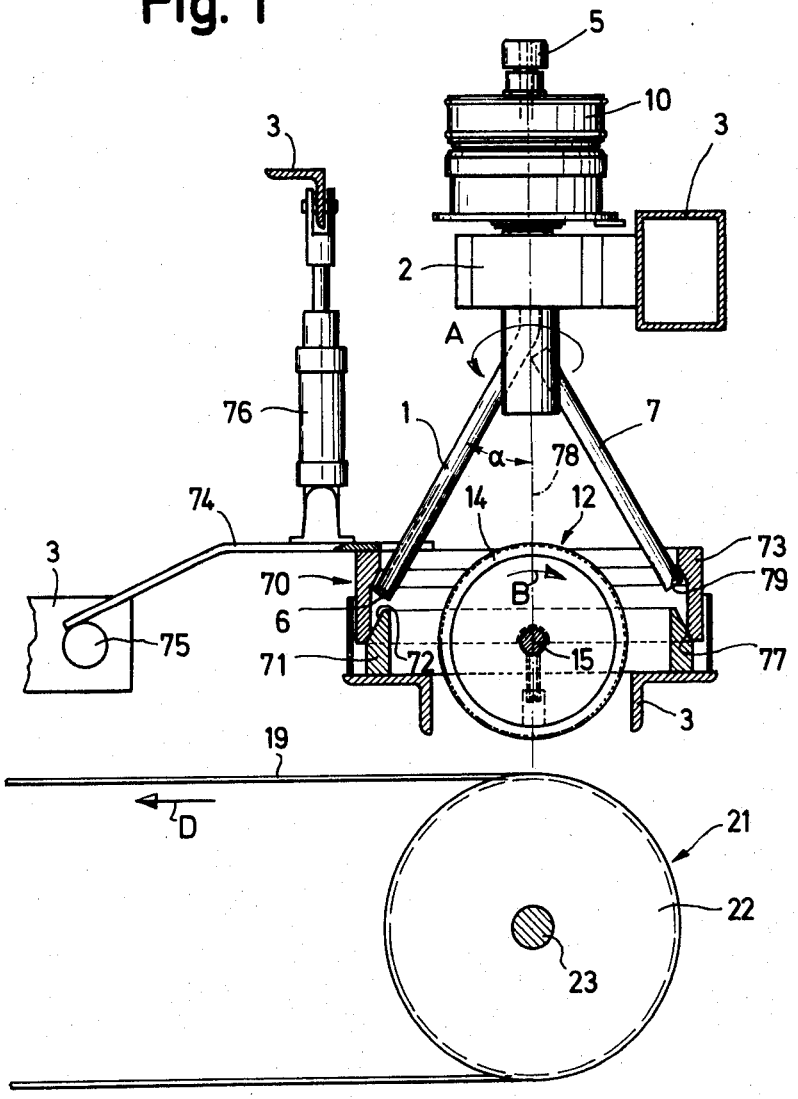
Figure 2:
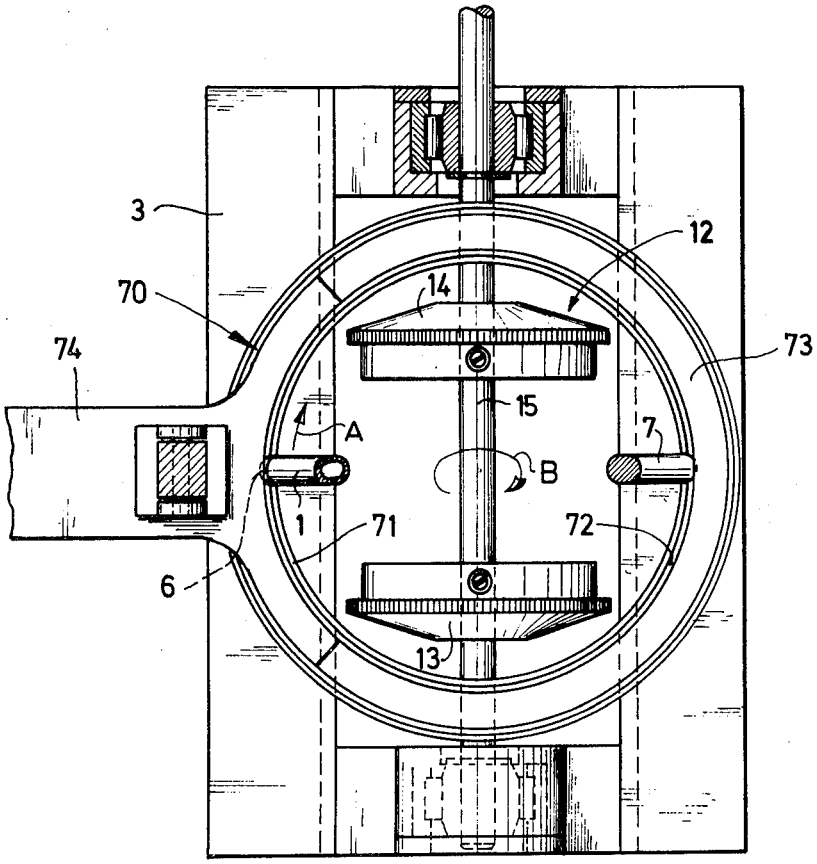

FIG. 1 is a schematic side view of one example of a yarn loop producing machine in accordance with the invention, and FIG. 2 is a part sectional plan view of the machine of FIG. 1.

As shown in FIG. 1, a conventional winding flyer or member 1 is supported by means of a pivot bearing 2 carried by the machine frame 3, and rotates in the direction of arrow A. The winding flyer 1 is in the form of a curved tube, further details of which are given in German Published specification DE-OS No. 31 14 535.3. Yarn is introduced at the rear end 5 into the winding flyer 1 and runs out at the front discharge end 6 following a circular path. Balancing is ensured by a counterweight 7 connected with and rotating with the winding flyer 1. The winding flyer 1 is coupled to a pulley 10 which is driven by a belt, the latter being driven by an electric motor through an adjustable drive.

A rotary driven winding means 12 moving in the direction of arrow B, is arranged in the rotation zone of the discharge end 6 of the winding flyer 1.

The winding means 12 comprises two disc-like loop carriers 13, 14 (FIG. 2), which in use are secured to but are axially adjustable on a rotary shaft 15 mounted in bearings carried by the machine frame 3. The shaft 15 is driven by means of a drive motor (not shown) having an infinitely adjustable gearbox. The outer surfaces of the loop-carriers 13, 14 have a roughened, knurled or toothed peripheral zone which receives the yarn-loops, thus preventing the loops from slipping.

On rotation of the winding flyer 1 and movement of the winding means 12, yarn-loops are continuously placed alongside each other on the winding means 12. As a result of the movement of the winding means 12 in the direction of the arrow B, the loops thus formed are placed one after the other and in partly overlapping manner upon a driven belt 19 which moves in the direction of arrow D, of a conveyor 21. The conveyor includes a pulley 22 mounted on a shaft 23 driven by an electric motor through a variable gearbox.

Between the laying of the loops on the winding means 12 and the transfer of the loops to the conveyor belt 21 they are turned through approximately 180°, so that the yarn may always be withdrawn from the top of the conveyor 21 without being hindered in the process by an overlying loop. On withdrawing the yarn the loops lying upon the conveyor belt 10 are not disturbed in their configuration and no undesirable tangling of the yarn takes place.

At the start of loop formation on the winding means 12 the free end of the yarn must be secured. For this purpose an automatic clamping arrangement 70 is provided. The clamping arrangement 70 comprises a first ring 71 fixed on the machine frame 3, and having an upwardly facing inwardly tapering surface 72. The surface 72 extends essentially parallel to the path of the part of the winding flyer 1 forming the discharge end 6, so that the end of the yarn runs parallel with surface 72. A second ring 73 is located above ring 71 and is able to move (essentially in an axial direction) in relation to the first ring 71. For this purpose the ring 73 is secured to a carrier 74, which in turn is pivoted about a shaft 75 set in bearings in the machine frame 3. A pneumatic cylinder 76 is located on the machine frame 3 and is connected to the carrier 74, whereby the ring 73 may be moved axially relative to ring 72. The second ring 73 also has a tapered surface 77, running parallel with surface 72 and engageable with surface 72 when the rings are brought into the closed position. The axis 78 shown in FIG. 1, of the rings 71, 73 also coincides with the axis of rotation of the winding flyer 1. The winding flyer shank carrying the discharge end 6 is inclined at an angle $\alpha$ in relation to shaft 78. The tapered surfaces 72, 77 also form an angle $\alpha$ relative to axis 78.

As shown in the drawing, the second ring 73 is designed in such a manner that it overhangs both the upper section of the first ring 71 as well as the discharge end of the winding flyer 1. In particular the discharge end 6 of the winding flyer 1 moves beneath a further tapered surface 79 located on the underside of the overhanging portion of ring 73. As shown, the first or lower ring 71 has a smaller overall diameter than the second ring 73.

For the purpose of the operation of the clamping arrangement 70 it is immaterial which of the rings 71, 73 is fixed and which is moving, ring 73 being the moving ring in the present example.

The clamping arrangement 70 operates in the following manner: Yarn laid in a sling is placed at the rear end 5 of the winding flyer 1 and is blown into place by compressed air in the usual manner, until the end of the yarn emerges from the discharge end 6. The clamping arrangement 7 is open at this stage, i.e. the ring 73 is lifted from ring 71. The yarn end emerging parallel to the tapered faces 72, 77 is shot by the compressed air between the tapered faces and the pneumatic cylinder 76 is operated to lower the upper ring 73 so that surfaces 72 and 77 engage with each other and clamping the end of the yarn between them.

The winding flyer 1, the winding means 12 and the conveyor belt 19 are then driven. Yarn loops are then formed on the winding means 12, for eventual transfer to the conveyor belt 19. The yarn end remains clamped between rings 71 and 73, until several loops have been formed and stabilised on the winding means 12. The ring 73 is then raised from ring 71, so that the end of the yarn is released from its clamped position and is laid on the conveyor belt 19 together with the first yarn loop initially formed.

The clamping arrangement 70 as the particular advantage, that it is effective in any given position of the winding flyer 1, since the yarn emerging from the discharge end 6 always comes between surfaces 72 and 77 and is then clamped. There is consequently no need for any special relative adjustment between the winding flyer 1 and the clamping arrangement 70. Although a pneumatic cylinder 76 is used in the present example, to effect relative movement of the rings, any other fluid pressure operated device or an electrically powered device may be used.

What is claimed is:

1. Apparatus for producing yarn loops comprising a rotary winding member having a discharge end through which, in use, yarn passes; a winding means for collecting yarn discharged from said winding member in the form of loops; a conveyor means for receiving loops of yarn from said winding means and conveying the loops received from the winding means to a remote position; and clamping means for the end of the yarn as it emerges from the discharge end of the winding member during the initial use of the apparatus, said clamping means including a pair of rings surrounding said winding means, said rings defining complementary surfaces the contours of which substantially correspond to the path of movement of the discharge end of the winding member, and means for moving the rings relative to each other so that the end of the yarn emerging from said discharge end can be trapped between said surfaces.

2. The apparatus of claim 1 wherein said winding member is inclined relative to its axis of rotation and said surfaces are inclined in a manner complementary to the winding member.

3. The apparatus of claim 1 wherein said surfaces are inclined and overlap each other.

4. The apparatus of claim 3 wherein said winding member is inclined relative to its axis of rotation and said surfaces are inclined in a manner complementary to the winding member.

5. The apparatus of claim 1 wherein one of said rings is mounted on a pivotal carrier and said means for moving the rings is coupled to said carrier.

6. The apparatus of claim 5 wherein said means for moving the rings includes an electrically powered device.

7. The apparatus of claim 5 wherein said means for moving the rings includes a fluid pressure operated device.

8. Apparatus for use with a machine for producing yarn loops which includes (a) a rotary winding member having a discharge end through which, in use, yarn passes, (b) a winding means for collecting yarn discharged from said winding member in the form of loops, and (c) a conveyor means for receiving loops of yarn from said winding means and conveying the loops received from the winding means to a remote position, said apparatus serving to clamp the end of the yarn as it emerges from the discharge end of the winding member during the initial use of the machine and comprising a pair of rings surrounding said winding means, said rings defining complementary surfaces the contours of which substantially correspond to the path of movement of the discharge end of the winding member, and means for moving the rings relative to each other so that the end of the yarn emerging from said discharge end can be trapped between said surfaces.

9. The apparatus of claim 8 wherein said winding member is inclined relative to its axis of rotation and said surfaces are inclined in a manner complementary to the winding member.

10. The apparatus of claim 8 wherein said surfaces are inclined and overlap each other.

11. The apparatus of claim 10 wherein said winding member is inclined relative to its axis of rotation and said surfaces are inclined in a manner complementary to the winding member.

12. The apparatus of claim 8 wherein one of said rings is mounted on a pivotal carrier and said means for moving the rings is coupled to said carrier.

13. The apparatus of claim 12 wherein said means for moving the rings includes an electrically powered device.

14. The apparatus of claim 12 wherein said means for moving the rings includes a fluid pressure operated device.

* * * * *